US008998118B2

(12) United States Patent
Simon et al.

(10) Patent No.: US 8,998,118 B2
(45) Date of Patent: Apr. 7, 2015

(54) TRUCK MOUNTED DEBRIS GRINDER

(71) Applicant: Gateway National Storage, LLC, Tampa, FL (US)

(72) Inventors: Paul J. Simon, Tampa, FL (US); Matthew C. Ruthig, New Port Richey, FL (US)

(73) Assignee: Gateway National Storage, LLC, Tampa, FL (US)

( * ) Notice: Subject to any disclaimer, the term of this patent is extended or adjusted under 35 U.S.C. 154(b) by 271 days.

(21) Appl. No.: 13/751,192

(22) Filed: Jan. 28, 2013

(65) Prior Publication Data

US 2014/0209713 A1 Jul. 31, 2014

(51) Int. Cl.

| | |
|---|---|
| ***B02C 21/02*** | (2006.01) |
| ***B02C 19/00*** | (2006.01) |
| ***B02C 19/16*** | (2006.01) |
| ***B02C 23/18*** | (2006.01) |

(52) U.S. Cl.

CPC ..... *B02C 21/02* (2013.01); *B02C 19/0056* (2013.01); *B02C 19/16* (2013.01); *B02C 23/18* (2013.01)

(58) Field of Classification Search

CPC ..... B02C 1/02; B02C 23/18; B02C 19/16
USPC ..... 241/101.76, 101.75, 101.74, 101.741, 241/101.71

See application file for complete search history.

(56) References Cited

U.S. PATENT DOCUMENTS

| | | | | |
|---|---|---|---|---|
| 4,232,719 | A * | 11/1980 | Payton | 144/34.1 |
| 5,209,413 | A * | 5/1993 | Dwyer et al. | 241/101.76 |
| 2005/0077404 | A1 * | 4/2005 | Kisenwether | 241/101.76 |
| 2006/0086849 | A1 * | 4/2006 | Weiss | 241/101.76 |

* cited by examiner

*Primary Examiner* — Mark Rosenbaum
(74) *Attorney, Agent, or Firm* — Larson & Larson, P.A.; Frank Liebenow; Patrick Reid

(57) ABSTRACT

A debris grinder interfaces directly with a typical roll-off container and a typical roll-off truck. By interfacing to the roll-off container, there is no need to feed waste by hand—an operation that is often dangerous to those operating the equipment. By interfacing with a typical roll-off truck, the debris grinder becomes mobile for spreading of the ground debris into the soil around the construction site. The debris grinder includes a skid portion for supporting and holding the roll-off container, a grinder portion for grinding debris from the roll-off container and depositing the ground-up debris onto the soil at the job site.

19 Claims, 4 Drawing Sheets

TRUCK MOUNTED DEBRIS GRINDER

FIELD

This invention relates to the field of debris disposal and more particularly to a system that diverts debris from the typical disposal/waste stream.

BACKGROUND

Landfills are quickly becoming crowded with materials that do not need to be disposed into landfills. Some waste needs to be disposed in landfills because it is not cost-effective to extract usable, recyclable material from such.

Once recyclable materials make it into the landfill, it become cost prohibitive to separate out the useful components of the waste and everything becomes waste, taking space. The best way to effect recycling is to separate materials at their source. Unfortunately, today, many construction sites generate large amounts of waste—trim from boards, saw dust, cut-outs of sheet rock, etc. Disposal of this debris created during construction is a problem. Currently, the created waste is hauled off the jobsite to a landfill. This results in in overflowing landfills, increased fossil fuel consumption, and additional costs to the contractor. It would be beneficial to dispose of some or most of these materials at the job-site. For example, some materials such as drywall and wood are actually beneficial to the soil surrounding the job-site. Devices exist to reduce these items to a form that is soil compatible. Such devices include stand-alone grinders, etc.

Existing, stand-alone debris grinders come in various forms, each having numerous disadvantages. Some grinders are labor intensive, requiring multiple personnel during operation. Others are very large, dedicated units, rendering them cost prohibitive for use on small construction projects. Small, inexpensive units exist, but such units must be fed by hand and are thus too slow to be practical. The small units also lack a useful way to distribute the resulting compost around the job-site.

SUMMARY

The problem of high costs associated with construction debris disposal is solved by a debris grinder that interfaces directly with a typical roll-off container and a typical roll-off truck. By interfacing to the roll-off container, there is no need to feed debris by hand—avoiding a dangerous process. By interfacing with a typical roll-off truck, the debris grinder becomes mobile. This mobile grinder grinds the debris, and then spreads the debris onto the soil around the construction site.

The roll-off container debris grinder allows for the waste disposal to occur on-site, avoiding additional cost and benefiting the soil. Benefits of mixing the ground debris into the soil include, but are not limited to, providing fertilizer to the soil (e.g. wood chips decay to provide fertilizer), conditioning the soil (gypsum, the main component in drywall is a known soil conditioner), and improving soil drainage (ground concrete increases soil drainage).

Leadership in Energy and Environment Design (LEED) is a certification system for energy efficient, or "green," buildings. Higher categories are reached by the accumulation of points, earned by certain elements of building construction, such as the use of energy efficient windows, recycled material, and recycling of construction waste on-site. When construction waste is disposed of on-site, the need to transport the waste to a landfill is eliminated. Reduction of waste place in landfills is rewarded under the LEED certification system by the granting of points toward a higher certification level. The additional points provide incentive to contractors to find alternatives to disposing their waste in landfills. Proper recycling of debris into the soil results in additional points for Leadership in Energy and Environmental Design (LEED) certification. LEED certification is a "green" building certification in which higher scores are obtained for construction that, for example, uses fewer resources and has higher energy efficiency, etc.

The roll-off container debris grinder includes the use of roll-off containers already present on-site for the collection of construction waste. Roll-off trucks previously used to transport the roll-off containers to the landfill provide a source of power for the grinder. The roll-off trucks also provide a way to move the grinder and distribute the processed materials into the soil at the construction site. The grinder is, for example, operated by the driver of the roll-off truck.

In one embodiment, an apparatus for grinding debris is disclosed. The apparatus includes a skid portion that is of a size and shape to hold a roll-off container and a grinder portion. The grinder portion is affixed to a first end of the skid portion and the grinder portion has a mechanism for grinding debris. Both the skid portion and the grinder portion are of a size and shape conducive to being transported on a bed of a roll-off truck.

In another embodiment, an apparatus for grinding debris is disclosed. The apparatus includes a skid portion. The skid portion is of a size and shape to hold a roll-off container and has a substantially planar top surface that interfaces with a bottom surface of the roll-off container. A first end of the skid portion has at least one foot on a bottom surface to separate the bottom surface of the skid portion from a surface on which the skid portion rests. The first end of the skid portion also has at least one cable hook-up interface for interfacing to a winch of a roll-off truck. The apparatus also includes a grinder portion that is affixed to a first end of the skid portion. The grinder portion has at least two grinding drums which are rotated by at least one hydraulic motor for grinding debris. Both the skid portion and the grinder portion are of a size and shape conducive to being transported on a bed of a roll-off truck.

In another embodiment, method of grinding debris at a job site is disclosed including the steps of accumulating debris in a roll-off container. The roll-off container has a door at a first end that is closed and latched. Next, the roll-off container and debris are lifted onto a bed of a roll-off truck then lowered onto a first end of a skid portion of a roll-off container debris grinder. Enough clearance is left between door and a debris grinding mechanism to open the door. The debris grinding mechanism located at a distal end of the skid portion. The door is then opened then the roll-off container is pushed further onto the skid portion until the first end of the roll-off container abuts the debris grinding mechanism. The roll-off container debris grinder is pulled up and onto the bed of the roll-off truck (e.g with a winch) until the debris grinding mechanism is lifted off of a surface at the job site. The debris grinding mechanism is connected to a source of power and started, thereby the debris passing through the debris grinding mechanism is processed into a form suitable for deposit into the surface of the job site.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
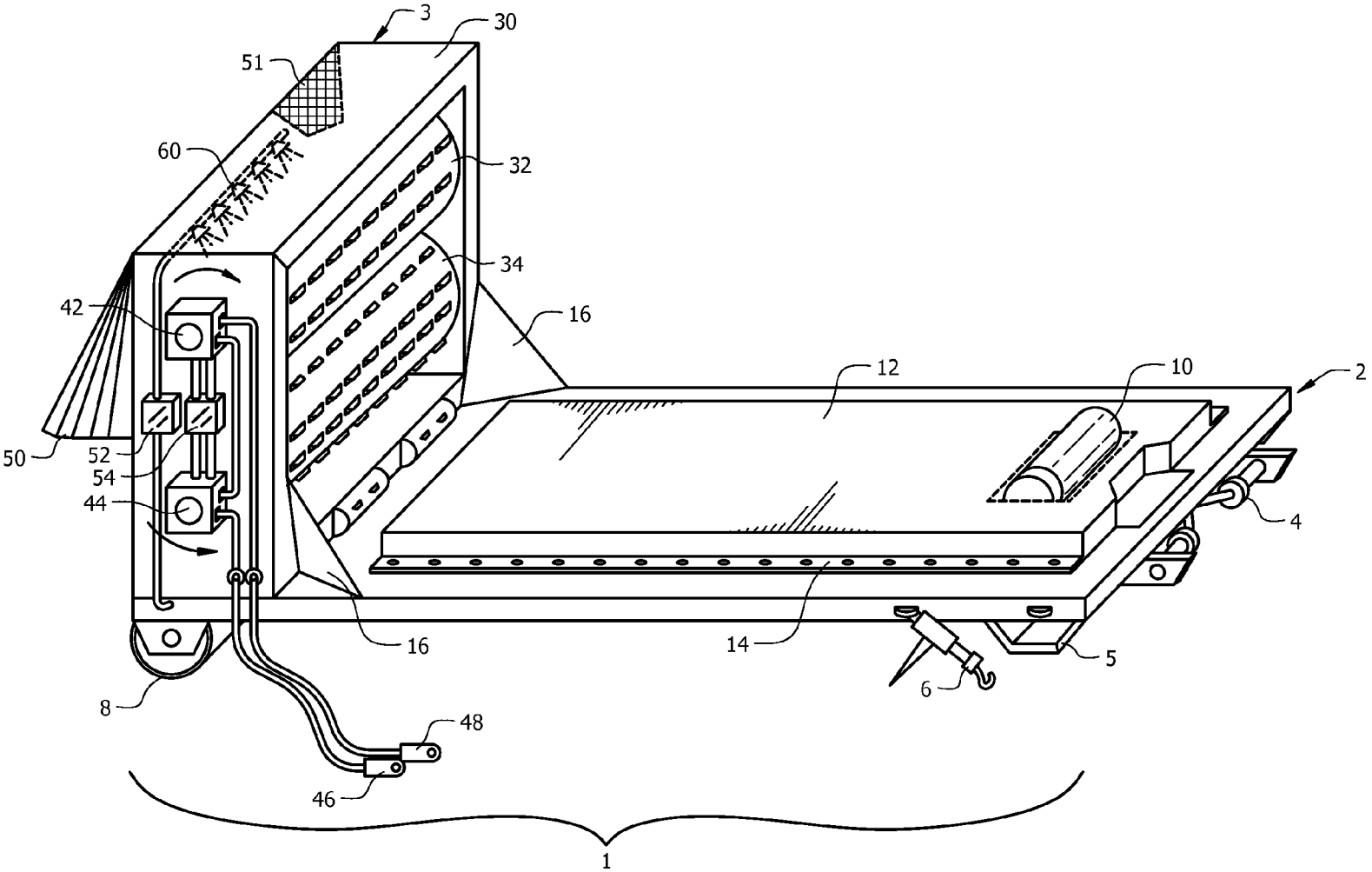
FIG. 1 illustrates a view of Roll-off Container Debris Grinder.

Reference will now be made in detail to the presently preferred embodiments of the invention, examples of which are illustrated in the accompanying drawings. Throughout the following detailed description, the same reference numerals refer to the same elements in all figures.

Referring to FIG. 1 an example of a roll-off container debris grinder 1 is shown. The roll-off container debris grinder 1 includes a skid portion 2 and a grinder portion 3. The skid portion 2 of the roll-off container debris grinder 1 slides beneath a standard roll-off container 90 or, in some embodiments, is part of the bottom surface of a roll-off container (not shown).

At one end of the skid portion 2, are one or more cable hook-up interfaces 4 and one or more feet 5. The cable hook-ups 4 are for attachment to the cable/winch system of existing roll-off trucks 80 (see FIGS. 2A-2C). The feet 5 elevate the skid portion 2, allowing the skid portion 2 to be pulled up onto the bed 92 of a roll-off truck 80.

Although not required, it is envisioned that one or many roll-off containers 90 (separated from the roll-off container debris grinder 1 and roll-off truck 80) are distributed about one or many construction sites while debris 94 is loaded. This allows for many roll-off containers 90 to be distributed and filled with debris 94 over a long period of time without occupying roll-off container debris grinders 1 and/or roll-off trucks 80. When the debris is ready to be processed (e.g. a roll-off container 90 is loaded with debris 94 or construction is complete), the roll-off container 90 is positioned onto the roll-off container debris grinder 1. Then both the roll-off container 90 and the roll-off container debris grinder 1 are positioned onto the bed 92 of the roll-off truck 80 to begin the processing operation, as will be shown.

In some cases, the roll-off container 90 is loaded with debris 94 while interfaced to the roll-off container debris grinder 1 and/or roll-off truck 80, as needed.

Figure 2A:
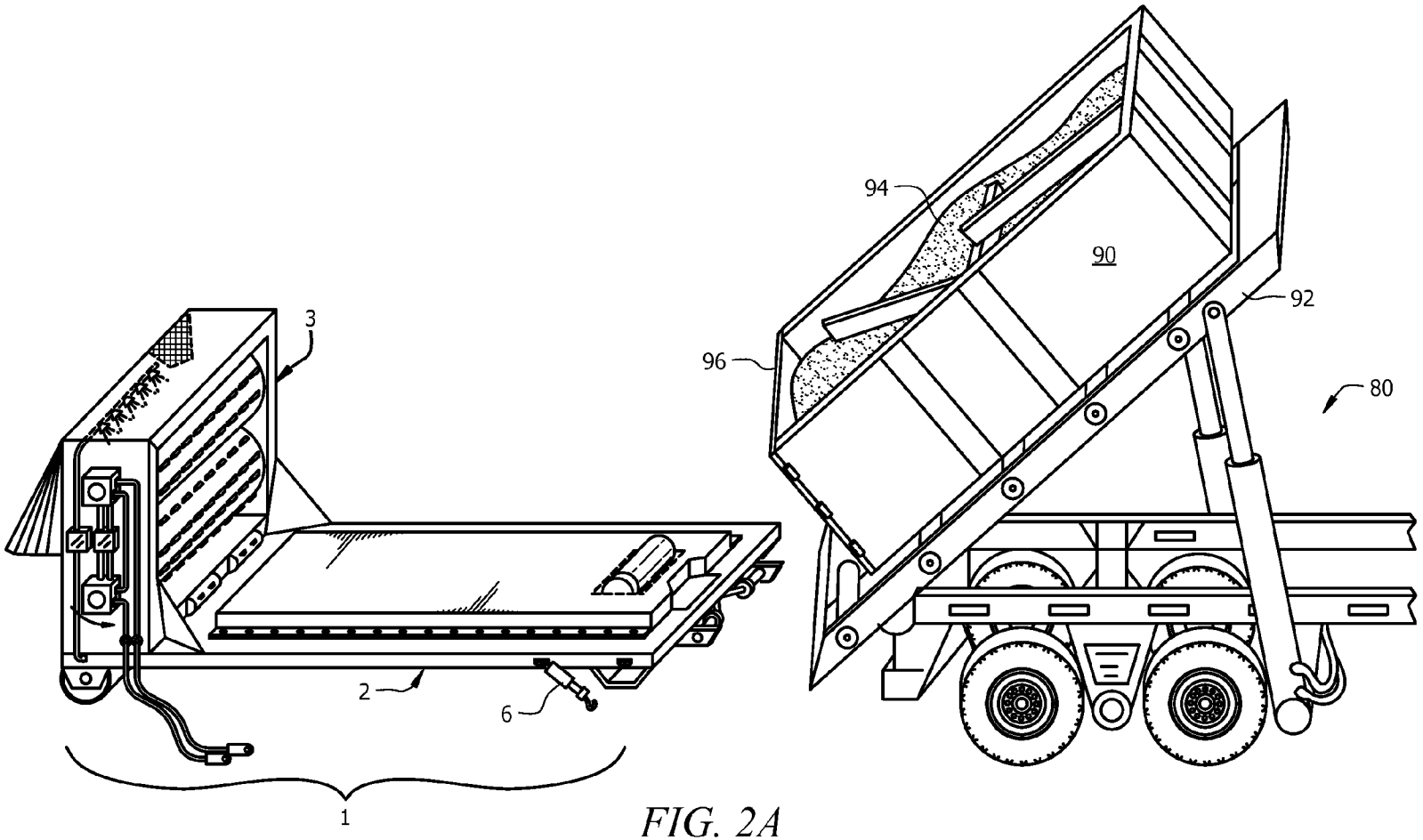
FIGS. 2A-2C illustrate the process of loading a Roll-off Container Debris Grinder.
Figure 2B:
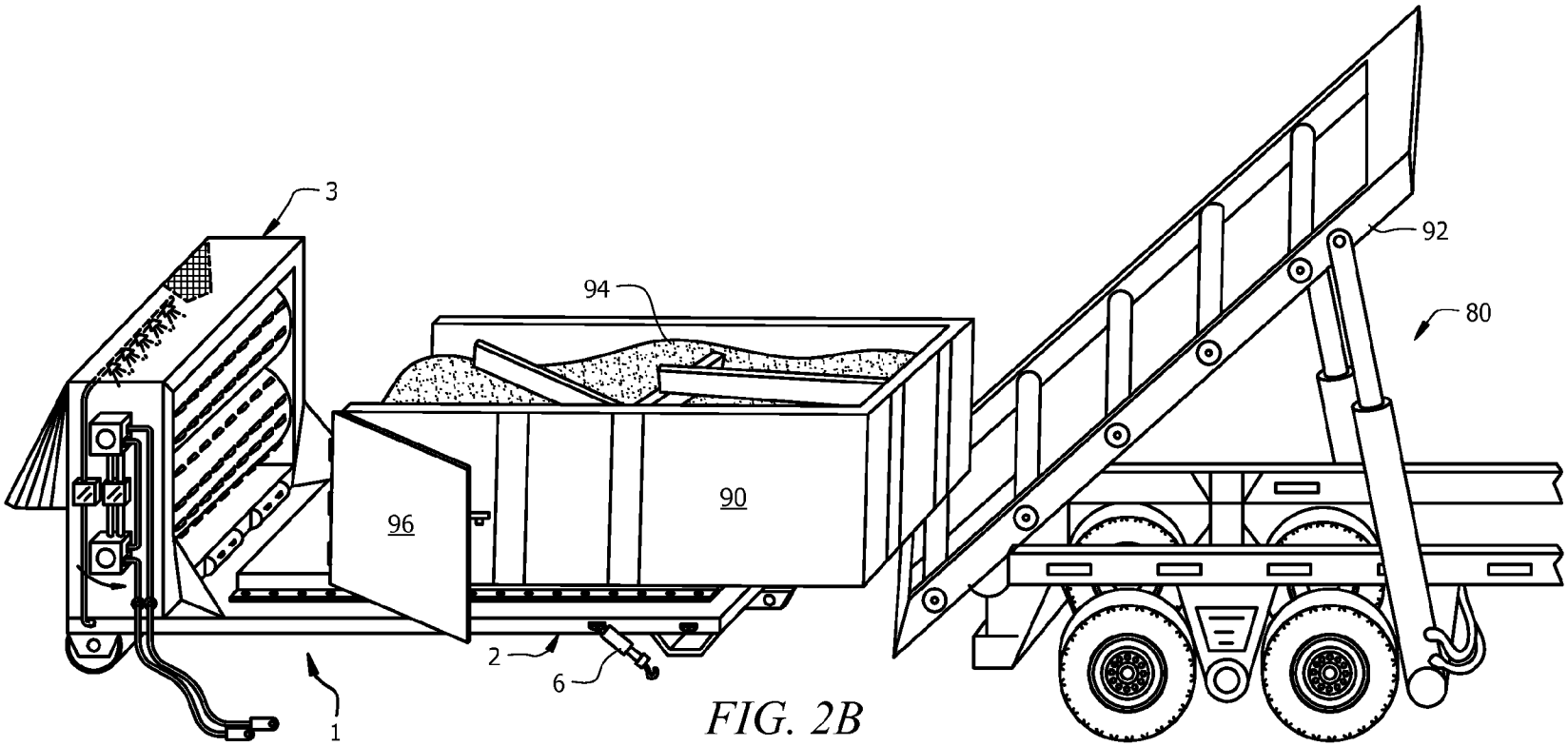

Although not required, the processing operation generally begins with the roll-off container 90 on the ground and loaded with debris 94 (not shown). The roll-off truck 80 pulls the roll-off container 90 up onto the bed 92 (as performed when loading a roll-off container 90) as shown in FIG. 2A. The roll-off truck 80 having a roll-off container 90, backs up to the roll-off container debris grinder 1 and lowers the roll-off container 90 from the truck bed 92 onto the skid portion 2 of the roll-off container debris grinder 1 as shown in the sequence of FIGS. 2A-2B. The roll-off container 90 slides along the skid portion 2 as shown in FIG. 2B, preferably leaving room to open the roll-off container door 96.

In some embodiments, one or more wheels 10 reduce friction between the skid portion 2 and the roll-off container 90, while guide rails 14 keep the roll-off container 90 on the skid portion 2 (preferably centered). Optionally, the wheels 10 are interfaced to a source of low-frequency vibration or shaking motion to loosen the debris 94 when the debris 94 clogs, jams, etc.

When the roll-off container 90 is positioned partially on the skid portion 2, to a point where the roll-off container 90 is on substantially the same plane as the skid portion 2 as in FIG. 2B, the rear door 96 of the roll-off container 90 is opened, allowing access to the debris 94. For example, the driver (or other person) opens the door 96.

After the door 96 is opened, the roll-off truck 80 continue to push the roll-off container 90 along the skid portion 2 until the roll-off container 90 is positioned on the skid portion 2, abutting the grinder portion 3.

At that point, the roll-off container 90 is optionally affixed to the skid portion 2, for example, with a binding strap or chain 6.

Before grinding begins (e.g., the waste material is within the roll-off container 90 and the roll-off container 90 is properly situated on the roll-off container debris grinder 1), the combined unit of the roll-off container 90 and the roll-off container debris grinder 1 is pulled onto the bed 92 of a roll-off truck 80, for example using the roll-off trucks winch (not shown). Optional rear wheels 8 improve movement of the rear area of the skid portion 2 along the ground as the roll-off container debris grinder 1 is pulled onto the bed 92. Once the combined unit of the roll-off container 90 and the roll-off container debris grinder 1 are on the bed 92 of a roll-off truck 80, power connections 46/48 are made to a power source of the roll-off truck 80. Many known power sources are available. The typical roll-off truck 80 has a hydraulic system with a controlled source/drain of hydraulic pressure. Other sources of power are equally anticipated including electric power. Additionally, in some embodiments, power is provided within the roll-off container debris grinder 1 using, for example, battery power. It is preferred, though not required, that the power connections be quick connect/quick disconnect.

Figure 2C:
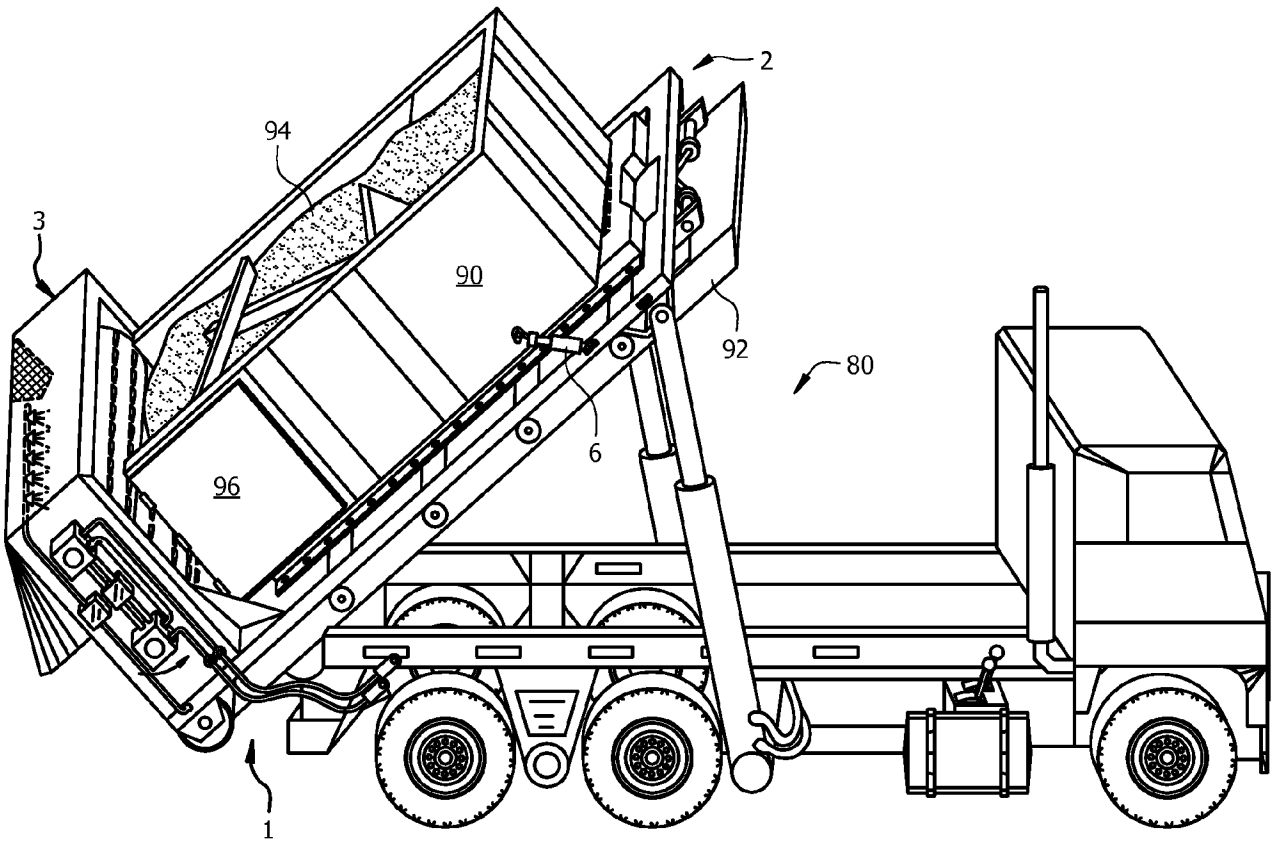

As the combined unit of the filled roll-off container 90 and the roll-off container debris grinder 1 is lifted on an angle as shown in FIG. 2C, the debris is urged towards the grinder portion 3 by gravity and optionally, a shaker 10. Next the driver of the roll-off truck 80 initiates operation of the grinder portion 3, which grinds the debris 94. The debris 94 is ground by the grinding wheels 32/34 into suitably sized pieces (e.g. dust, granular, small stones, etc.) for proper integration into the soil at the job site.

Although not required, the grinding operation is performed while the roll-off truck 80 moves across the job-site, thereby distributing the suitably sized pieces of debris 94. Alternately, the roll-off truck 80 remains stationary, creating a pile of suitably sized pieces of debris 94 that is later distributed.

The grinder portion 3 accepts the debris 94 from the roll-off container 90, grinds the debris 94 and emits the ground debris out to the environment.

Although the grinder portion 3 is shown with two grinding wheels 32/34, any number of grinding wheels 32/34 is anticipated. Two grinding wheels 32/34 are shown in the example shown in FIG. 1, an upper grinding wheel 32 and a lower grinding wheel 34. The grinding wheels 32/34 are contained within a housing 30 and are powered by an upper motor 42 and a lower motor 44, respectively. The motors 42/44 are typically hydraulic motors 42/44, although any type and form of motor 42/44 is anticipated. Any speed and format of grinder 3 is anticipated. In the example shown, two drum grinding wheels 32/34 rotate at, for example 600 rpm or 1500 rpm. Slower rotation produces synergy of dumping and grinding.

In some exemplary systems, angled guides 16 help position the roll-off container 90 in relationship to the grinding wheels 32/34.

In some systems the motors 42/44 are hydraulic motors 42/44, connected to supply line 46, and return line 48 on the roll-off truck 80. In such systems, the operation of the motors 42/44 is managed by, for example, hydraulic motor controller 54 and/or controls within the roll-off truck 80. These systems provide control to the operator of the roll-off truck 80. This allows a single operator to control the motors 42/44 while also handling the motion of the roll-off truck 80.

Because the grinding of some debris 94 (e.g., drywall, concrete) results in the production of large amounts of dust, and potentially flying debris, some roll-off container debris grinders 1 include shrouds 50 and/or water spray systems. The shroud 50 aims the ground debris towards the ground. The shroud 50 is made from or lined with, for example, rubber or similar material to absorb the energy of the particles.

The water spray system, if present, includes a water tank 12, water pump 52, and nozzles 60. In some systems, the water pump 52 is powered by a source of rotational energy such as a hydraulic motor or an electric motor. In some systems, the water tank 12 is pressurized during filling, and a valve (not shown) opened to allow water to flow to the nozzles 60. Although the water tank 12 is shown as part of the skid portion 2, any size, shape and location of the water tank 12 is anticipated.

A safety grate 51 is optionally included, protecting operators from unintentional contact with the upper and lower grinding wheels 32/34.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. An apparatus for grinding debris, the apparatus comprising:

a skid portion, the skid portion being of a size and shape to hold a roll-off container;

a grinder portion, the grinder portion affixed to a first end of the skid portion, the grinder portion having means for grinding debris; and both the skid portion and the grinder portion of a size and shape conducive to being transported on a bed of a roll-off truck;

wherein the skid portion is substantially planar, having rails to guide the roll-off container.

2. The apparatus for grinding debris of claim 1, wherein the means for grinding includes at least two grinding drums, the grinding drums rotated by at least one hydraulic motor.

3. The apparatus for grinding debris of claim 2, wherein the at least one hydraulic motor is interfaced to a source of hydraulic power, the source of hydraulic power being the roll-off truck.

4. The apparatus for grinding debris of claim 1, further comprising a shroud, the shroud at least partially covering an outflow side of the means for grinding, thereby directing particulate debris downward towards earth.

5. The apparatus for grinding debris of claim 1, further comprising a water system comprising at least one nozzle and a source of water, the at least one nozzle directed towards the means for grinding, thereby reducing dust output while the debris is being ground.

6. The apparatus for grinding debris of claim 5, wherein the source of water is a water tank integrated in the skid portion.

7. The apparatus for grinding debris of claim 1, further comprising means for vibrating the roll-off container, the means for vibrating assisting in moving the debris towards the means for grinding during operation.

8. The apparatus for grinding debris of claim 1, further comprising at least one fastening device, a first end of the fastening device affixed to the skid portion and a second end of the fastening device removably attaches to the roll-off container, thereby holding the roll-off container in position on the skid portion.

9. An apparatus for grinding debris, the apparatus comprising:

a skid portion, the skid portion being of a size and shape to hold a roll-off container, the skid portion has substantially planar top surface that interfaces with a bottom surface of the roll-off container, a first end of the skid portion has at least one foot on a bottom surface to separate the bottom surface of the skid portion from a surface on which the skid portion rests, the first end of the skid portion has at least one cable hook-up interface for interfacing to a winch of a roll-off truck;

a grinder portion, the grinder portion affixed to a first end of the skid portion, the grinder portion having at least two grinding drums, the grinding drums rotated by at least one hydraulic motor for grinding debris; and both the skid portion and the grinder portion of a size and shape conducive to being transported on a bed of a roll-off truck.

10. The apparatus for grinding debris of claim 9, wherein the at least one hydraulic motor is interfaced to a source of hydraulic power, the source of hydraulic power being from the roll-off truck.

11. The apparatus for grinding debris of claim 9, wherein the skid portion is substantially planar, having rails to guide the roll-off container.

12. The apparatus for grinding debris of claim 9, further comprising a shroud, the shroud at least partially covering an outflow side of the means for grinding, thereby directing particulate debris downward towards earth.

13. The apparatus for grinding debris of claim 9, further comprising a water system comprising at least one nozzle and a source of water, the at least one nozzle directed towards the means for grinding, thereby reducing dust output while the debris is being ground.

14. The apparatus for grinding debris of claim 9, further comprising a vibration generating mechanism, the vibration generating mechanism assists in moving the debris towards the at least two grinding drums during operation.

15. A method of grinding debris at a job site, the method comprising the steps of:

lifting a roll-off container onto a bed of a roll-off truck, the roll-off container having debris disposed therein and a door at one end of the roll-off container is closed and latched;

lowering the roll-off container and debris onto a first end of a skid portion of a roll-off container debris grinder allowing sufficient clearance between door and a debris grinding mechanism to open the door, the debris grinding mechanism located at a distal end of the skid portion;

opening the door;

pushing the roll-off container further onto the skid portion until the first end of the roll-off container abuts the debris grinding mechanism;

pulling the roll-off container debris grinder up and onto the bed of the roll-off truck until the debris grinding mechanism is off of a surface at the job site;

connecting the debris grinding mechanism to a source of power; and starting the debris grinding mechanism, thereby the debris passing through the debris grinding mechanism is processed into a form suitable for deposit into the surface of the job site.

16. The method of claim 15, further comprising a step of operating the roll-off truck to move around the job site, thereby distributing the debris as it is processed across the job site.

17. The method of claim 15, wherein the step of connecting the debris grinding mechanism to the source of power is connecting two hydraulic lines from the debris grinding mechanism to a hydraulic supply/return of the roll-off truck.

18. The method of claim 15, further comprising a step of spraying water over the debris as it is processed, thereby reducing dust.

19. The method of claim 15, wherein the step of pulling the roll-off container debris grinder and roll-up container up and onto the bed of the roll-off truck until the debris grinding mechanism is off of the surface at the job site includes leaving the roll-off container debris grinder and roll-up container tilted at an angle such that the debris is urged towards the debris grinding mechanism.

* * * * *